United States Patent [19]

Koboshi et al.

[11] 4,277,556

[45] Jul. 7, 1981

[54] PROCESS FOR TREATING LIGHT-SENSITIVE SILVER HALIDE COLOR PHOTOGRAPHIC MATERIALS

[75] Inventors: Sigeharu Koboshi; Isamu Fushiki, both of Hino; Kenro Sakamoto, Odawara, all of Japan

[73] Assignee: Konishiroku Photo Industry Co., Ltd., Tokyo, Japan

[21] Appl. No.: 824,817

[22] Filed: Aug. 15, 1977

[30] Foreign Application Priority Data

| | | | |
|---|---|---|---|
| Aug. 18, 1976 | [JP] | Japan | 51-98367 |
| Dec. 16, 1976 | [JP] | Japan | 51-151339 |
| Jun. 3, 1977 | [JP] | Japan | 52-66125 |

[51] Int. Cl.[2] ..... G03C 5/32; G03C 7/16

[52] U.S. Cl. ..... 430/393; 430/943

[58] Field of Search ..... 96/60 R, 60 B F, 22; 423/272, 273; 430/393, 460, 943

[56] References Cited

U.S. PATENT DOCUMENTS

| | | | |
|---|---|---|---|
| 2,426,154 | 8/1947 | Reichert et al. | 423/272 |
| 3,208,825 | 9/1965 | Meeker | 423/272 |
| 3,256,092 | 6/1966 | Means et al. | 96/60 R |
| 3,617,282 | 11/1971 | Bard et al. | 96/22 |
| 3,674,490 | 7/1972 | Matejec | 96/60 R |
| 3,681,022 | 8/1972 | Kibbel et al. | 423/273 |
| 3,687,627 | 8/1972 | Stalter | 423/273 |
| 3,773,510 | 11/1973 | Fisch | 96/60 BF |
| 3,820,997 | 6/1974 | Shirasu et al. | 96/60 BF |
| 3,870,520 | 3/1975 | Shimamura et al. | 96/60 BF |
| 4,061,721 | 12/1977 | Strong | 423/272 |

FOREIGN PATENT DOCUMENTS

| | | | |
|---|---|---|---|
| 1045373 | 12/1958 | Fed. Rep. of Germany | 96/66.4 |
| 2432721 | 1/1975 | Fed. Rep. of Germany . | |
| 2522978 | 12/1975 | Fed. Rep. of Germany . | |
| 1222415 | 2/1971 | United Kingdom . | |

OTHER PUBLICATIONS

Kirk Othmer, vol. 11 pp. 391–417 Encyclopedia of Chemical Technology.

Research Disclosures RD-14846 and 14847.

W. Machu, "Das Wassenstoffperoxd und die Peruerbindungen," (1937) pp. 185–194

7,576

*Primary Examiner*—Mary F. Downey

*Attorney, Agent, or Firm*—Frishauf, Holtz, Goodman & Woodward

[57] ABSTRACT

Process for treating a light-sensitive silver halide color photographic material which comprises removing, after color development of the imagewise exposed light-sensitive silver halide color photographic material, the image silver with a bath containing hydrogen peroxide or a hydrogen peroxide releasing compound in combination with at least one compound selected from the group of lower alkyl aliphatic carboxylic acid, alkylidene diphosphonic acid and an alkali metal salt thereof under the conditions of forming substantially no dye image.

17 Claims, No Drawings

PROCESS FOR TREATING LIGHT-SENSITIVE SILVER HALIDE COLOR PHOTOGRAPHIC MATERIALS

This invention relates to a process for treating a light-sensitive silver halide color photographic materials. Particularly, this invention relates to a process for treating the light-sensitive silver halide color photographic material which comprises removing, after color-development of the image-wise exposed light-sensitive silver halide color photographic material, the image silver with a bath containing hydrogen peroxide or a hydrogen peroxide releasing compound under the conditions of forming substantially no dye image. More particularly, this invention relates to a process for treating the light-sensitive silver halide color photographic material with the bath containing at least one of an organic acid, particularly a lower aliphatic carboxylic acid or an alkali metal salt thereof and/or an alkylidene diphosphonic acid or an alkali metal salt thereof in combination with hydrogen peroxide or a hydrogen peroxide releasing compound. Furthermore this invention relates to a process for treating the light-sensitive silver halide color photographic material with the bath containing at least one of an inorganic salt made of a metal specified hereinafter, in combination with hydrogen peroxide or a hydrogen peroxide releasing combound and a lower aliphatic carboxylic acid or an alkali metal salt thereof and/or an alkylidene diphosphonic acid or an alkali metal salt thereof.

In order to obtain a color image by developing a imagewise light-sensitive silver halide color photographic material, it has been performed, in general, by bleaching a developed silver image with a bleaching agent (an oxidizing agent) and then to desilver it with a fixing agent after color development. The above-mentioned method comprises two-step processes, viz. bleaching and fixing.

A process called "bleach-fixing" was proposed in which bleaching and fixing were completed in one step at the same time to simplify the conventional processes for the purpose of rapid processing and dispensation of labor.

The bleaching solution used for the bleaching process contains, as a bleaching agent, e.g. a red prussiate, ferric chloride or a metal complex salt of an organic acid such as EDTA-iron complex salt. The bleach-fixing solution used for the bleach-fixing is, in general, an aqueous solution containing a bleaching agent and a fixing agent as the main components.

As the bleaching agent are employed, e.g. red prussiates, ferric chloride or metal complex salts of organic acids such as EDTA-iron complex salt, as in the above-mentioned bleaching solution.

As the fixing agent which is present in the solution with the bleaching agent are employed thiosulfates such as sodium thiosulfate or ammonium thiosulfate; thiocyanates such as potassium thiocyanate or sodium thiocyanate; or thiourea which are usually employed for the fixing of the light-sensitive silver halide photographic material.

Red prussiates and ferric chloride have a strong oxidizing activity, and therefore, have a good property for the bleaching agent. They have, however, certain drawbacks. To wit, the bleaching solution and the bleach-fixing solution containing a red prussiate as the bleaching agent release cyanides by photo-degradation, and the waste water containing the same has to be treated completely from the viewpoint of preventing environmental pollution.

In case of the bleaching solution containing ferric chloride as the bleaching agent, it tends to corrode equipment due to its very low pH value and strong oxidizing activity. Moreover, it causes so-called "stain", by precipitating ferric hydroxide in an emulsion layer during washing after bleaching. This necessitates washing with an organic chelating agent, after bleaching, which additional process is contrary to the purpose of rapid processing and dispensation of labor, and involves a problem of environmental pollution.

It has been recommended in recent years to employ a metal complex salt of an organic acid such as EDTA-iron complex salt as the bleaching agent due to its relatively low toxicity and advantage from the viewpoint of preventing environmental pollution, as compared with red prussiates and ferric chloride.

Such an organic metal complex salt, however, has relatively weak oxidizing activity and shows insufficient bleaching. For example, when it is used as the bleaching agent, the intended purpose can be achieved to some extent if a low-sensitive silver halide color photographic material comprising chiefly silver chlorobromide emulsion is bleached or bleach-fixed. However, the intended purpose can hardly achieved if a spectral-sensitized, high-sensitive silver halide color photographic material comprising chiefly silver chlorobromoiodide or silver iodobromide emulsion, particularly a light-sensitive silver halide color photographic material for reversal use comprising silver in a high content in the emulsion is processed due to inefficient bleaching or bleach-fixing, causing poor desilvering.

It has recently been considered desirable to employ a metal complex salt of an organic acid such as EDTA-iron complex salt as the bleaching agent, from the viewpoint of prevention of environmental pollution. However, even such compounds may pollute environment due to their high BOD and COD. Further, as mentioned above, they show insufficient bleaching activity.

Rapid process of a high-sensitive silver halide color photographic material can be achieved by overcoming the above-mentioned drawbacks.

For this purpose, it has been proposed by now to add a bleaching accelerator to the bleaching solution or bleach-fixing solution which contains, as a bleaching agent, a metal complex salt of an organic acid such as EDTA-iron complex salt.

Such bleaching accelerators are, e.g. thiourea derivatives described in Japanese Patent Publication No. 458506, serenourea derivatives described in U.S. Pat. No. 3,701,662, five-membered ring mercapto compounds described in British Patent No. 1,138,842, aliphatic amines described in Japanese Patent Publication No. 46-556 and thiourea derivatives, thiazole derivatives or thiadiazole derivatives described in Swiss Patent No. 336,257.

However, many of such compounds do not necessarily exhibit a fully satisfactory bleaching accelerating activity, or are not so stable in solution as to allow long effective life of the solution or storage thereof for a long time. Some others do not exhibit a bleaching accelerating activity when they are contained in the so-called "pre-bath" used before bleaching or bleach-fixing.

Thus, several kinds of bleaching solution have been proposed but no useful and practical bleaching solution for high-sensitive silver halide color photographic materials has been found yet and it has been strongly needed to have a bleaching agent without any drawbacks mentioned above.

It is the first object of the invention to provide a novel method for processing light-sensitive silver halide color photographic materials. It is the second object of the invention to provide a method for processing light-sensitive silver halide color photographic materials comprising a novel bleach-fixing process.

It is the third object of the invention, particularly in the processing of a color photographic material which involves bleach-fixing, to provide a bleach-fixing solution which can shorten the processing period by speeding up the bleach-fixing velocity and produce color photographic images with a good quality.

It is the fourth object of the invention to provide a method for processing light-sensitive silver halide color photographic materials with a rapid bleaching velocity, using a simple composition with cheep material which is fit for the requirement of protection of natural resources.

It is the fifth object of the invention to provide a method for processing light-sensitive silver halide color photographic materials which are low in danger for environmental pollution and are expected not to pollute the environment seriously.

The inventors have found that the above-mentioned objects can be attained by processing, after color developing an imagewise-exposed silver halide light-sensitive color photographic material, with a solution containing hydrogen peroxide or a hydrogen peroxide releasing compound under the conditions forming substantially no dye image.

Here, "the conditions forming substantially no dye image" means the compositions which are impossible for the processing bath to intensify the image, different from the range of color development intensification as disclosed in U.S. Pat. No. 3,674,490, and does not mean the physical conditions which interrupt the mixing of the color developing agent into the bath and prohibit substantially the formation of color image but mean so-called chemical conditions which form substantially no color image, even if the color developing solution happens to be mixed with the bath. Therefore, the above conditions according to this invention do not necessarily exclude the physical conditions which interrupt the mixing of color developing agent into the processing bath of this invention and prohibit the formation of color formation. However it is preferred, in addition to the above chemical conditions, to use in combination a means to satisfy the physical conditions in order to prohibit completely the image intensification.

The inventors have confirmed, after extensive studies, that the bleaching of image silver with hydrogen peroxide can be achieved only under specific conditions and that the hydrogen peroxide is decomposed catalytically on the surface of silver, and thus the image amplification takes place in the presence of color developing agent under normal conditions as described in U.S. Pat. No. 3,674,490.

To wit, the inventors have found that the bleaching of silver with hydrogen peroxide can not take place within the region in which the image is amplified, and that it can only take place by using the above-mentioned bath which is so adjusted in a region which is different than the above-mentioned region in which the image is amplified.

It is said that the image amplification commonly known takes place when the hydrogen peroxide is decomposed catalytically with the image silver, producing oxygen which oxidizes the coexisting developing agent.

It is known in this instance that the image amplification takes place repeatedly because the image silver is oxidized, as described in U.S. Pat. Nos. 3,765,891 and 3,674,490.

In fact, it was confirmed that the image silver remained as metallic silver when the image amplification took place.

It is accordingly essential to adjust the bleaching or bleach-fixing solution containing hydrogen peroxide or a hydrogen peroxide releasing compound of this invention to such a condition that image amplification does not take place to a substantial extent.

As one example to satisfy the above-mentioned conditions, the solution of the invention is adjusted at pH 2–6 and an organic acid and/or the alkali metal salt thereof added thereto.

The inventors have found that the image silver is oxidized irreversibly by using hydrogen peroxide jointly with a compound which is capable of forming a weak complex with silver. Whereas, addition of a substance adsorbed strongly on silver, or a substance capable of forming a very stable complex with silver causes a catalytic decomposition of hydrogen peroxide without oxidation of silver. In the latter instance, it is impossible to oxidize the image silver; namely, it is in such a region that only the image amplification can take place.

The hydrogen peroxide to be contained in the processing bath according to this invention may be, e.g. a commercially available aqueous hydrogen peroxide solution, or gaseous hydrogen peroxide. Alternatively there may be employed compounds capable of releasing hydrogen peroxide in the aqueous solution, e.g. perborates and percarbonates.

As to compounds which may be added to the processing bath according to this invention for the satisfaction of the above conditions under which substantially no color image is formed, any compounds can be used which make possible bleach-fixing of image silver in combination with hydrogen peroxide or hydrogen peroxide releasing compound. Preferably an organic acid or an alkali metal salt thereof (where a metal complex salt thereof is excluded) can be used. At least one selected from the group consisting of a lower alkyl aliphatic carboxylic acid having the following general formula (I) or (II) or an alkali metal salt thereof (where a metal complex salt of said carboxylic acid or an alkali metal salt thereof is excluded) or an alkylidene diphosphonic acid having the following general formula (III) or an alkali metal salt thereof can be more preferably used. The metal complex salt of said carboxylic acid or the alkali metal salt thereof means a very stable metal complex salt.

Formula (I):

$$R_1—COOH$$

wherein $R_1$ represents a hydrogen atom or an alkyl group having 1 to 3 carbon atoms which may be substituted with one or more hydroxyl groups, alkyl groups having 1 to 3 carbon atoms and/or amino radicals.

Formula (II):

$$HOOC—(R_2)_{n1}—COOH$$

wherein $R_2$ represents an alkylene or alkenylene group both having 1 to 5 carbon atoms each of which may be substituted with one or more hydroxyl groups, alkyl groups having 1 to 3 carbon atoms, carboxyl groups and/or amino radical and $n_1$ represents zero or 1.

Formula (III):

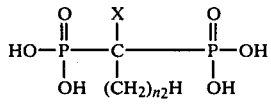

wherein X represents a hydrogen atom or hydroxyl group and $n_2$ represents zero or an integer of 1 to 5.

Preferred carboxylic acid used for this invention are mono- or polycarboxylic acids, oxycarboxylic acids and amino acids in which said carboxylic acids may be substituted with a hydroxyl group, alkyl group of 1–3 carbon atoms and/or amino group. These carboxylic acids may also be alkali metal salts thereof. But a halogensubstituted carboxylic acid in which the carboxylic acid is substituted with a halogen atom, for example, chloroacetic acid is excluded from the scope of this invention because this compound can not attain the object of this invention.

Representative lower alkyl aliphatic carboxylic acids having formula (I) or (II) and alkali metal salts thereof are as follows: formic acid, acetic acid, propionic acid, butyric acid, oxalic acid, malonic acid, succinic acid, lactic acid, isosuccinic acid, glutaric acid, adipic acid, glycolic acid, citric acid, oxycitric acid, tartaric acid, α-oxy-n-butyric acid, oxymalonic acid, malic acid, α-methylmalic acid, α-oxyglutaric acid, 2,3-dioxypropionic acid, asparaginic acid, glutamic acid, aminoacetic acid, β-alanine, serine, diaminosuccinic acid, aminomalonic acid, maleic acid, and alkali metal salt thereof such as potassium acetate, sodium acetate potassium citrate, sodium citrate.

Representative alkylidene diphosphonic acids having formula (III) are as follows: 1-hydroxyethylidene-1,1-diphosphonic acid, methylenediphosphonic acid, ethylidene-diphosphonic acid, 1-hydroxybutylidene-1,1-diphosphonic acid, 1-hydroxypropylidene-1,1-diphosphonic acid and the like.

As other organic acids, ethylenediaminetetraacetic acid, nitrilotriacetic acid, 1,3-diaminopropan-2-ol-tetraacetic acid, cyclohexanediaminetetraacetic acid, N-hydroxyethylenediaminetriacetic acid, glycoletherdiaminetetraacetic acid, iminodiacetic acid, hydroxyiminodiacetic acid, triethylenetetraaminehexaacetic acid or their alkali salt or polyphosphonic acid salt, metaphosphonic acid and the like can be exemplified.

These compounds can be used alone or in combination of two or more. But these compounds are only representative ones and compounds capable of bleach-fixing the image silver in combination with hydrogen peroxide are not meant to be limited to these representative compounds.

Of the compounds capable of bleach-fixing the image silver in combination with hydrogen peroxide or a hydrogen peroxide releasing compound, formic acid, acetic acid, propionic acid, citric acid, alkylidene diphosphonic acid, alkylamine diphosphonic acid or their alkali metal salt are preferable in view of their bleach-fixing performance, their availability and their cost.

An amount of hydrogen peroxide or a hydrogen peroxide releasing compound incorporated in the bleach-fixing solution according to this invention varies according to the kinds of compound used in combination with the hydrogen peroxide, kinds of photographic material, the treatment temperature and the treatment period of the object, a range of 0.05–3.0 mole of hydrogen peroxide per one liter of the processing solution results in a good result. In general, the smaller the added amount, the longer the treatment period is. When the added amount is greater than necessary, the reaction becomes extremely active and sometimes foams, and so-called blisters occur on the surface of the treated film. Therefore, it is necessary to determine an amount of hydrogen peroxide to be added in every case to get the optimum result. An amount used of the compound capable of bleach-fixing of the image silver in combination with hydrogen peroxide is preferably 5 to 150 g per one liter of the processing bath. In concrete terms, in cases where a lower alkyl aliphatic carboxylic acid having formula (I) or (II) or an alkali metal salt thereof, providing that a metal complex salt of the carboxylic acid or alkali metal salt thereof is excluded and this hold hereinafter, the amount is 0.05 to 3.0 moles per one liter of the processing solution. In the case of an alkylidene diphosphonic acid or alkali metal salt thereof, it is 0.01 to 1.0 mole per one liter. But the amount to be added is not limited. Therefore, it must be preferably determined depending on the compound used with hydrogen peroxide, a kind of the light-sensitive silver halide color photographic materials to be treated, a treatment time of the object, a treatment conditions (for example, pH, temperature etc.) and an amount of hydrogen peroxide to be added.

It is generally considered that the above blister occurs due to excessive rapidity of the bleaching reaction of silver with hydrogen peroxide. Therefore, in cases where lowering of the occurrence of blistering is attempted, the bleaching reaction is also suppressed. Accordingly, it is very difficult to make the suppression of blistering consistent with the bleaching reaction. However, the present inventors found that the use of 0.05 to 3.0 mole/l of the lower alkyl aliphatic carboxylic acid having the formula (I) or (II) and 0.01 to 1.0 mole/l of an alkylidene diphosphonic acid having the formula (III) does not cause blistering to occur, even if some treatment conditions change. Such a combination gives unexpected results in that the bleaching reaction is greatly promoted in comparison with the use of two components consisting of hydrogen peroxide and carboxylic acid or hydrogen peroxide and alkylidene diphosphonic acid. The blister suppression effect is also permanent.

Further, of the processing baths according to this invention, it was found that a bath containing a specific combination of the organic acid and hydrogen peroxide has an extremely excellent advantage in that it can remarkably prohibit the reduction in treatment performance induced by the fact that halogen ion could be brought into the solution with the treatment.

Still more, in cases where a great amount of light-sensitive silver halide color photographic materials are treated running, large amounts of halogen ions are mixed into the processing solution or a large amount of color developing solution is mixed into the processing solution, the reduction in treatment performance can often be seen.

Further, when an inorganic salt of the elements disclosed hereinafter (referred to as the elements of this invention) is added to the processing bath containing hydrogen peroxide and an organic acid to satisfy the conditions forming substantially no color image, it is found that the bleach-fixing ability can be remarkably promoted and the bath does not suffer the suppression of the bleach-fixing reaction due to the mixing of halogen ions or color developing agents, so that the additions of the elements of this invention can perform an extremely excellent bleach-fixing promotion effect.

The elements of this invention are as follows: silver, gold in b Family of I Group, calcium, strontium and barium in a Family of II Group, Zinc in b Family of II Group, gallium, indium and thallium in a Family of III Group, tin, and lead in a Family of IV Group, titanium, zirconium in b Family of IV Group, bismuth in a Family of V Group, vanadium in b Family of V Group, chromium, molybdenum and tungsten in b Family of VI Group, ruthenium, rhodium, palladium, osmium, iridium and platinum in VIII Group and cerium of lanthanum system element.

Inorganic salts composed of the elements of this invention (referred to as the inorganic salts of this invention) are, for example, as follows: silver sulfate, silver nitrate, silver oxide, silver phosphate, auric hydroxide, calcium sulfate, calcium hydroxide, calcium oxide, calcium nitrate, calcium carbonate, strontium nitrate, strontium sulfate, strontium oxide, barium sulfate, barium carbonate, barium nitrate, barium oxide, lead carbonate, lead hydroxide, lead oxide, lead nitrate, zinc sulfate, zinc nitrate, zinc carbonate, gallium oxide, gallium hydroxide, gallium sulfate, gallium alum., indium hydroxide, indium oxide, indium sulfide, thallium nitrate, thallium carbonate, thallium sulfate, thallium hydroxide, titanium sulfate, titanium oxide, zirconium (III) oxide, zirconium sulfate, stannic oxide, stannic acid, stannous hydroxide, bismuth (III) oxide, bismuth hydroxide, bismuth (V) oxide, bismuth nitrate, bismuth sulfate, bismuth carbonate, vanadium (V) oxide, vanadium (II) oxide, vanadium (III) oxide, chromium sulfate, chromic nitrate, chrome alum., potassium perchromate, molybdenum (III) oxide, ammonium molybdate, molybdenum (V) sulfide, tungsten (III) oxide, sodium tungstate, iridium (II) oxide, palladium oxide, palladium sulfate, palladium nitrate, osmium (II) oxide, osmium (IV) oxide, rhodium sulfate, rhodium (III) oxide, potassium ruthenate, ruthenium (II) oxide, ruthenium (IV) oxide, platinum hydroxide, platinum (III) oxide, platinum (II) oxide, barium tetracyanoplatinate, auric hydroxide, aurous hydroxide, auric cyanide, cerium oxide, cerium (II) sulfate, ammonium cerium (II) nitrate and the like. But the inorganic salts of this invention are not meant to be limited to these exemplified salts. The inorganic salts of this invention are effective even if they are not perfectly dissolved. For example, they can be used as precipitates which are not completely dissolved in water or as a suspension of the inorganic salts of this invention. Of the inorganic salts, halide compounds prohibit rather than promote the treatment performance, therefore, they are not suitable for this invention. Other elements than the elements of this invention for example, cadmium, germanium, antimony, arsenic, selenium, tellurium, manganese and the like are excluded from this invention because of their availability, environmental pollution and toxicity, and the fact that they have little effect on bleach-fixing promotion. Organic salts of the elements of this invention, especially carboxylic acids (for example, acetate), exhibit some effect but are less effective than inorganic salts. They are also excluded from this invention.

Of the inorganic salts of this invention, the most preferred inorganic salts are barium salts, osmium salts, tungstates, silver salts, aurates, platinates, cerium salts, chromium salts, selenates, and the like from the standpoint of an excellent effect for bleaching or bleach-fixing promotion, availability, low cost and environmental pollution.

The amount to be added of the inorganic salts of this invention is in the range of $10^{-5}$ to 0.5 mole/l and preferably $10^{-4}$ to $10^{-1}$ mole/l. But this amount is not limited and must be preferably determined in every case depending on the kind of inorganic salts used of this invention, kind of light-sensitive silver halide color photographic materials to be treated, treatment times desired, treatment conditions (for example, pH and temperature) and added amounts of hydrogen peroxide. For example, in the case of an inorganic salt which forms a stable metal complex salt with an organic salt which was added in advance, as it is apt to decompose hydrogen peroxide, the amount used of such an inorganic salt is preferred to be a small amount, for example, in the range of from $10^{-2}$ to $10^{-5}$ mole/l.

The pH of the processing bath of this invention is adjusted to be from 2.0 to 6.0, preferably 2.0 to 5.5. In the case of the pH of the bath being less than 2.0, the bleaching reaction is extremely prohibited. In the case of the pH of the bath being more than 5.5, the prohibitive effect on blister formation of this invention can not be performed sufficiently. Keeping the pH of the bath less than 5.5 is preferred for storage and stability of the bath. Hydrogen peroxide is apt to decompose rapidly at an alkali pH, but does not automatically decompose below pH 5.5. For example, in the case of the pH of the bath containing hydrogen peroxide being less than 5.5, a known stabilizer for hydrogen peroxide does not show any effect. In this case, when the pH of the bath is increased to more than 6.0, said stabilizer shows some effect and a remarkable effect in the case of the pH being over 7. Therefore, it is very important for this invention to keep the pH of the bath in the range of more than 2.0 to less than 5.5 in view of the bleaching reaction, blister suppression effect and liquid stability. The preferred pH of the bath according to this invention is from 3.0 to 5.0, preferably 3.0 to 4.5.

The bleach-fixing solution of this invention can sometimes be extremely promoted due to silver ions dissolved out from the light-sensitive silver halide color photographic materials treated and other substances dissolved out from said photographic materials. When metallic silver is dissolved in advance into the bleach-fixing solution of this invention, the bleaching ability of the solution can often be extremely promoted. Therefore metallic silver can be in advance added into the solution.

As hydrogen peroxide is used as an oxidizing agent for the silver image in the bleach-fixing solution of this invention, other oxidizing agents are not particularly necessary. But organic oxidizing agents such as persulfate salt can be used.

A large amount of organic metallic complex salt of copper, cobalt and nickel is preferably not present because they decompose hydrogen peroxide and prohibit the reaction. For example, organic acid metallic complex salts such as EDTA-iron complex salt are excluded from this invention.

The processing bath of this invention does not require conventional oxidizing agents such as EDTA-iron complex salts and red prussiates which are highly poisonous and environmentally polluting. Hydrogen peroxide is easily decomposed to give water and oxygen, so that it can be rendered harmless. The processing bath of this invention has advantages in that the materials used for the bath are not expensive and show an excellent bleach-fixing even if they are used in a low concentration.

These advantages are profitable from the point of supply sources and make it possible to supply inexpensive bleach-fixing solutions which cause little environmental pollution. The bleach-fixing solution of this invention is highly soluble easily regulatable and very stable itself.

The silver dissolved out by processing the light-sensitive silver halide color photographic material with the processing bath (bleach-fixing bath) is considered to dissolve out in part as an organic acid silver salt, for example, a carboxylic acid silver salt. In fact, in cases where an organic acid, especially acetic acid as the organic acid, is used, the solution can dissolve out silver ions in the solution to the extent of 1 g/l, and when large amounts of photosensitive materials are treated, more silver salt than is dissolved precipitates in fine particles. This easy precipitation can be greatly increased by further adding an alkylidene diphosphonic acid and the like. Accordingly, the recovery of silver from the processing bath can be easily carried out by separating the automatically precipitated silver by means of centrifugation, filter filtration, precipitation separation, metal substitution method and the filtrate can therefore be used repeatedly. Further, by making the processing solution alkaline, it is possible to recover from the bath all of the precipitated and dissolved silver at one time and the hydrogen peroxide decomposes into water and oxygen at the same time so as to be harmless.

As the processing bath of this invention (bleach-fixing solution) has an extremely large area of photosensitive materials to be treated per unit volume of the processing solution, a supply amount to the solution can be greatly reduced when in production. In some cases, it can be advantageously reduced to the extent of not substantially, overflowing.

As the processing bath of this invention (bleach-fixing solution) has a high oxidation potential, the color dye formed can not remain as leuco dye. In conventional bleaching or bleach-fixing solutions, especially containing iron (II) aminopolycarboxylate as an oxidizing agent, many couplers often remained as leuco dyes. As yellow couplers of 4 equivalents and cyan couplers of 2 and 4 equivalents often remained as leuco dyes, they had many disadvantages in practical use. Further, in the case of conventional bleaching and bleach-fixing solutions, especially containing iron (II) aminopolycarboxylate as an oxidizing agent, they become iron (III) aminopolycarboxylate by oxidizing silver. This compound has strong reducing ability so that it reduces the treatment ability of the processing solution or reduces dyes. As hydrogen peroxide does not produce such a reduced form of silver, the treatment reduction during use is not found.

As the processing bath (bleach-fixing solution) of this invention has excellent bleach-fixing performance as described above, the method for processing of this invention is effectively applied for high-sensitive silver halide color photographic materials, to say nothing of low-sensitive silver halide color photographic materials. But it can be effectively used for photosensitive materials containing a large amount of silver, especially for several color photosensitive materials from the point of the reaction characteristics of the processing solution of this invention. It can be also applied sufficiently enough for light-sensitive silver halide color photographic materials of color negative or color paper. It may be applied not only to the "inner type development method" in which the coupler is contained within the light-sensitive material (U.S. Pat. Nos. 2,376,679, 2,322,027 and 2,801,171), but also to the so-called "outer type development method" in which the coupler is contained in the developing solution (U.S. Pat. Nos. 2,252,718, 2,592,243 and 2,590,970).

The bleach-fixing solution of the invention may be applied in the processing of any silver halide color photographic material, e.g. color negative film, color paper, color positive film, color reversal film for slides, movie or TV.

It may be applied also to the processing of color material for silver dye bleaching method.

The light-sensitive color photographic material applied to the process of the invention comprises at least two silver halide emulsion layers, the color-sensitivity of which are different, coated on a base.

The silver halide emulsion may be prepared by dispersing a light-sensitive silver halide such as silver chloride, silver iodide, silver chlorobromide, silver bromide, silver iodobromide or silver chloroiodobromide on a hydrophilic colloidal binder.

As the hydrophilic colloidal binder, are mentioned, e.g. portions such as gelatin, colloidal albumin or casein; cellulose derivatives such as carboxymethyl cellulose or hydroxyethyl cellulose; polysaccharides such as agar, sodium alginate or starch, or hydrophilic synthetic colloids such as polyvinyl alcohol, poly-N-vinylpyrrolidone, polyacrylic acid or polyacrylamide.

The silver halide emulsion may be prepared, according to heretofore known methods e.g., single jet method, double jet method or controlled double jet method, by mixing a water-soluble silver salt, such as silver nitrate, with a water-soluble halide, such as potassium bromide, in the presence of water and a hydrophilic colloid. It is then subjected to physical or chemical maturing such as gold and/or sulfur sensitization.

The silver halide emulsion may contain, during preparation or immediately before coating, a sensitizing dye such as cyanine dye or merocyanine dye or a mixture thereof described in U.S. Pat. Nos. 2,493,748, 2,519,001, 2,977,229, 3,480,434, 3,672,897, 3,703,377, 2,688,545, 2,912,329, 3,397,060, 3,615,635, 3,628,964, 3,522,052, 3,527,641, 3,615,613, 3,515,632, 3,617,295, 3,635,721 and 3,694,217; a stabilizer such as 4-hydroxy-6-methyl-1,3,3a,7-tetraazaindene; a sensitizer such as a compound described in U.S. Pat. No. 3,619,198; a fog-preventing agent such as benzotriazole or 5-nitrobenzimidazole; a hardening agent, e.g. an aldehyde such as formalin or glyoxal, or a non-aldehyde compound such as mucochloric acid or 2-hydroxy-4,6-dichloro-s-triazine described in U.S. Pat. Nos. 3,288,775, 2,732,303, 3,635,718, 3,232,763, 2,732,316, 2,586,168, 3,103,437, 3,017,280, 2,983,611, 2,725,294, 2,725,295, 3,100,704, 3,091,537, 3,321,313 and 3,543,292, or a coating aid such as saponin, sodium laurylsulfate, dodecylphenol polyethyleneoxide ether or hexadecyltrimethyl ammonium bromide.

The mean grain size of silver halide thus obtained and contained in the emulsion is 0.1–2.0μ, preferably 0.2–1.5μ.

The process of the invention may preferably be applied to silver halide light-sensitive color photographic material containing a coupler. As examples of such a coupler which is generally diffusion-resistant are mentioned, e.g. four or two equivalent type open chain ketonemethylene series yellow couplers described in U.S. Pat. Nos. 2,875,057, 3,265,506, 3,277,155, 3,337,344, 3,408,194, 3,409,439, 3,415,652, 3,447,928, 3,551,155, 3,551,156 and 3,582,322, Japanese Patent Provisional Publication Nos. 47-26133, 48-66834, 48-66835 and 48-66836; four or two equivalent type pyrazolone or indazolone series magenta couplers described in U.S. Pat. Nos. 2,600,788, 2,983,608, 3,006,759, 3,062,653, 3,214,437, 3,253,924, 3,331,476, 3,419,391, 3,419,808, 3,476,560 and 3,582,322, Japanese Patent Publication No. 45-20636 and Japanese Patent Provisional Publication No. 47-26133; four or two equivalent type phenol or naphthol series cyan couplers described in U.S. Pat. Nos. 2,474,293, 2,698,794, 3,034,892, 3,214,437, 3,253,924, 3,411,476, 3,458,315, 3,476,563, 3,582,322 and 3,591,383, Japanese Patent Publication No. 42-11304, 44-32461 and 45-28836.

In addition to the above, DIR couplers described in U.S. Pat. Nos. 3,227,554, 3,297,445, 3,253,924, 3,311,476, 3,379,529, 3,516,831, 3,617,291 and 3,705,801 and German Offenlegungsschrift No. 2,163,811 could also be used.

The coupler may be prepared for dispersion according to the method described in U.S. Pat. No. 2,801,171.

It is also possible to add a development inhibitor releasing coupler, trivially called DIR coupler, or a development inhibitor releasing compound, upon color reaction.

Examples of such couplers are mentioned in U.S. Pat. Nos. 3,148,062, 3,227,554, 3,253,924, 3,297,445, 3,379,529, 3,617,291, 3,622,328, 3,639,417 and 3,705,201, British Patent Publication No. 1,201,110, Japanese Patent Provisional Publication No. 49-104630, 49-77635, 49-84439, 49-70669 49-25482, 48-143291, 48-128984 and 48-128985.

In order to satisfy characteristics required for light-sensitive materials, it is possible to add more than two kinds of couplers and other additives into the same layer. It is also possible to add an additive into different layers.

The silver halide emulsion thus obtained may be coated on a base such as glass plate, baryta paper, resin-coated paper, cellulose acetate film or polyethylene terephthalate film by dipping method, air knife method, bead code method or extrusion doctor method.

The coated silver halide emulsion layer consists usually of three layers, viz. blue-sensitive, green-sensitive and red-sensitive emulsion layers.

Incidentally, at least one of the above-mentioned layers may further be divided into two or more layers. For example, the green-sensitive emulsion layer may be divided into high and low sensitive layers. Furthermore, a protective layer (upper layer) or an intermediate filter-, antihalation- or back-layer may be coated, if necessary.

The method of the invention comprises the development and bleach-fixing which are independent of another. But the filter layer and antihalation layer using colloidal silver in this invention have no practical problem but stains remained, so that they are unfavorable layers. Here, the development means both black and white development and color development. This means that in this invention there may be employed color development or black and white development, each alone or jointly.

The above-mentioned processes are not necessarily to be performed continuously.

There may be contained, before or after the above-mentioned processes, various processes called "additional process"; viz. stopping bath, stop-fixing bath, hardening bath, neutralizing bath, washing, and rinsing image-stabilizing bath.

The bleach-fixing solution of the invention is preferably applied to the process in which bleach-fixing is performed immediately after the color development from the viewpoint of abbreviation of processes.

In this case, the treatment ability of the bleach-fixing solution of this invention cannot be reduced and the solution can be applied effectively even if developing agents or halogen ions may be mixed into the solution. But for more effective treatment, and depending on the kinds of photographic photosensitive materials to be treated and on other necessities, the bleach-fixing should be preferably performed, after color development, optionally via one or more washing, rinsing, stopping, stop-fixing and bleach-fixing prebath (so-called conditioner for efficient bleach-stopping) or hardening treatment.

It may be also possible for a specific purpose to process, after bleach-fixing treatment, with a conventional bleach-fixing solution or fixing solution besides the bleach-fixing solution of the invention. That is, for removing image silver, the processing bath (bleach-fixing solution) of this invention may be placed at any process stage.

The following is concrete examples of the treatment processes according to this invention but is not meant to limit the scope of the invention.

(1) Black and white first development→stopping→water washing→color development→[bleach-fixing]→water washing→stabilization→drying.

(2) Black and white first development→stopping→water washing→fog bath→color development→rinsing→[bleach-fixing]→water washing→stabilization→drying.

(3) Pre-hardening→neutralization→black and white first development→water washing→color development→stopping→[bleach-fixing]→bleach-fixing*→washing→stabilization→drying.

(4) Black and white first development→stopping→water washing→color development→hardening→neutralization→[bleach-fixing]→stain-removing bath→water washing→stabilization→drying.

(5) Black and white first development→stopping→color development→stopping→black and white second development→rinsing→[bleach-fixing]→stain-removing bath→water washing→stabilization→drying.

(6) Black and white first development→stopping→water washing→color development→conditioner(prebath)→[bleach-fixing]→water washing→stain-removing bath→washing→stabilization→drying.

(7) Black and white first development→stopping→[bleach-fixing]→water washing→color development→[bleach-fixing]→water washing→stabilization→drying.

(8) Color development→[bleach-fixing]→water washing→[bleach-fixing]→water washing→stabilization→drying.

(9) Color development→stopping→water washing→[bleach-fixing]→fixing→water washing→stabilization→drying.

(10) Color development→rinsing→[bleach-fixing]→fixing→water washing→stabilization→drying.

(11) Color development→stop-fixing→water washing→[bleach-fixing]→water washing→stabilization→drying.

(12) Color development→stopping→[bleach-fixing]→bleach-fixing*→water washing→stabilization→drying.

(13) Hardening→neutralization→color development→rinsing→[bleach-fixing]→stain-removing bath →water washing→stabilization→drying.

(14) Color development→stopping→water washing→black and white development→water washing→[bleach-fixing]→stain-removing bath→washing→stabilization→drying.

(15) Color development→water washing→dye-bleaching→water washing→[bleach-fixing]→stain-removing bath→water washing.

In the above schema, the bleach-fixing process with brackets is the process in which the bleach-fixing solution of the invention is used; and that with an asterisk is the process in which a conventional bleach-fixing solution is used, respectively.

In the development process of the invention, there may be contained various known additives to be added to black and white development, or commonly known black and white first development solution for light-sensitive color photographic materials, or black and white development solutions for light-sensitive black and white photographic materials.

As the representative additives, there may be mentioned, e.g. developing agents such as 1-phenyl-3-pyrazolidone, Metol or hydroquinone; anti-oxidizing agents such as sulfites; accelerators comprising an alkali such as sodium hydroxide, sodium carbonate and potassium carbonate; organic or inorganic retarders such as potassium bromide, 2-mercaptobenzimidazole or methylbenzthiazole; water softeners such as polyphosphates; or surface perdevelopment-preventing agents comprising a trace amount of potassium iodide or mercaptides.

The color-developing solution of the invention is an aqueous alkaline solution containing a known aromatic primary amine color-developing agent, i.e. a phenylenediamine derivative such as N,N-diethyl-p-phenylenediamine sulfate, 4-amino-N-ethyl-N-β-hydroxyethylaniline sulfate, 3-methyl-4-amino-N-ethyl-β-methanesulfoamidoethylaniline sesquisulfate monohydrate, 3-methyl-4-amino-N-β-hydroxyethylaniline sulfate, 3-methyl-4-amino-N,N-diethylaniline hydrochloride or 4-amino-N-ethyl-3-methoxy-N-(β-methoxyethyl)aniline di-p-toluenesulfonate.

It may also contain a sulfite, bisulfite, bromide or iodide; a fog-preventing agent; a solvent such as diethylene glycol or benzyl alcohol; a water softener such as polyphosphate; organic or inorganic development-accelerator; and when necessary, a chemical fogging agent such as aminoboran; or an accelerator comprising an alkali such as sodium carbonate, potassium carbonate, sodium phosphate or metaphosphate.

In case a light-sensitive color photographic material containing no coupler is developed, it is performed using a color developing solution containing a coupler in accordance with a method described in, e.g. U.S. Pat. Nos. 2,252,718, 2,259,243 or 2,590,970. The pH value of black and white and color developing solutions ranges from about 9 to 13.

For specific purposes such as stain removing, a bleach-fixing solution may be eventually used for processing with the bleach-fixing solution of the invention. Such a solution may be any known, conventional bleach-fixing solution or fixing solution of a known formulation. For example, any bleach-fixing solution or fixing solution containing EDTA-ferrous complex salt as the oxidizing agent, and one or more thiosulfate, thioether-glycolthiocyanate, bromide, thiourea or iodide as the fixing agent may optionally be employed.

The desired purpose may sufficiently be obtained by using from 1/20 to ⅓ concentration of the conventional solution as compared with the usual concentration when it is used after processing with the bleach-fixing solution of the invention, for it is not the aimed purpose to bleach-fixing the image silver by oxidation.

On the other hand, in the reversal color photographic photo-sensitive material treatment, the undeveloped silver halide can be fogged so as to be developed after black-white first development and before color development. This is done by means of the second exposure process to light and a chemically fogging agent. The latter process can be carried out by adding directly the fogging agent to the color developing solution and by means of treatment of a so-called fogging bath, a bath containing a fogging agent before color developing treatment. In a fogging bath as an additive process, fogging agents of borane system disclosed in U.S. Pat. Nos. 2,984,567, 3,246,987, 3,554,748 and 3,563,746 and of tin complex salt disclosed in U.S. Pat. Nos. 3,617,282, 3,563,746 and Japanese Patent Publication No. 46-25956 can be used.

Before the process with the processing bath of this invention a so-called pre-treatment can be carried out for the further purpose of carrying out the bleaching reaction as soon as possible. In this pre-treating bath can be contained formalin, organic thiol compound, saponin, other anionic, cationic and nonionic surface active agents, sulfuric acid and persulfuric acid.

Among additional processes, the stop-fixing may be performed by using a known, conventional stopping bath stop-fixing solution.

Further any conventional hardening bath or neutralizing bath may optionally be employed depending on the purpose.

The pH value of the additional processing bath may optionally be adjusted depending on the purpose.

Of the pre-treating processes, a conventional fixing bath and stop-fixing solution can be used for the fixing bath and stop-fixing solution. There can be mentioned a hardening bath and neutralizing bath, which can be optionally selected from conventional ones according to the object. The pH of these pre-treating processes can be adjusted to any desired value from the object by regulating pH of the treating bath.

The processing bath (bleach-fixing solution) of this invention can attain the object by the use of a combination of hydrogen peroxide and the organic acid capable of bleach-fixing the image silver, but it can contain further an additive, if necessary. For example, pH buffer agents such as sulfonic acid, boric acid, borax, sodium hydroxide, potassium hydroxide, sodium hydrogen carbonate, potassium hydrogen carbonate, acetic acid, sodium acetate, ammonium hydroxide can be contained alone or in combination of two or more. Further, polymers such as poly-N-vinylpyrrolidone, fluorescent brightening agent, defoamers and several kinds of surface active agents such as anionic, cationic and nonionic and saponin can be contained in it. If necessary, it can contain one or more fixing agents for silver halide, organic solvents such as methanol, dimethylformamide, dimethylsulfoxide or dioxane and hydrogen peroxide stabilizers such as acetanilide, pyrophosphonic acid, urea oxine, and barbituric acid.

It may also contain, depending upon the kind of photographic materials to be treated, a hardening agent comprising various compounds including those belonging to alums or aldehydes; an antiswelling agent such as magnesium sulfate, sodium sulfate, etc.; and a reducing agent such as a sulfite, hydrazine, etc.

Further, when conventional fixing agents such as thiosulfates and thiocyanates are added to the processing bath (bleach-fixing solution) of this invention, the undeveloped silver halide can be fixed but the bleaching of silver due to hydrogen peroxide become uneffected because of loss of the surface activity of image silver, so that it becomes impossible to remove the image silver. Therefore, the addition of these fixing agents to the bleach-fixing solution of this invention is not desirable.

The treatment temperature with the processing bath (bleach-fixing solution) is at a temperature of 20° to 90° C., generally preferably 35° to 60° C. for rapid treatment. But when the temperature is too high, the same kinds of couplers used in photosensitive materials are apt to undergo a change of dye tune formed or badly affect the dye storage, stability and solidness. As the bleach-fixing solution of this invention has a sufficiently rapid treatment ability at a lower temperature, some kinds of couplers in photosensitie materials to be treated are preferred to be processed at a temperature as lower as possible.

This invention will be further illustrated more concretely by the following examples but they are not meant to limit the scope of the invention.

EXAMPLE 1

Sakura Color Reversal R-100 (a high-sensitive color reversal film, available from Konishiroku Photo Ind. Co., Ltd.) was exposed quantitatively to a tungsten lamp, adjusting the color temperature to 4900° K. with a filter, and then processed in accordance with the following A and B:

(A) Process using Bleach-fixing solutions (a)-(c)

The process was performed according to the following procedures at 29.5° C. throughout the entire procedures;

[Pre-hardening, 3 min.]→[Neutralization, 1 min.]→[First development, 6 min.]→[First stopping, 2 min.]→[First water washing, 4 min.]→[Color development, 9 min.]→[Second stopping, 3 min.]→[Second water washing, 3 min.]→[Bleach-fixing, 2 min.]→[Third water washing, 6 min.]→[Stabilization, 1 min.]→[Drying]; 40 min. in total:

(B) Process using stain-removing bath after processing with bleach-fixing solution (a)-(c) (The procedures before second washing are identical with above-mentioned (A).) [Abbr.]→[Second water washing, 3 min.]→[Bleach-fixing, 2 min.]→[stain-removing, 20 sec.]→[Third water washing, 6 min.]→[Stabilization, 1 min.]→[Drying]; 40 min. and 20 sec. in total:

The process was performed at 29.5° C.±0.5° C. throughout the entire procedure except when bleach-fixing was performed.

The bleach-fixing solution (a) for control mentioned below is not in accordance with the invention, whereas the bleach-fixing solutions (b) and (c) are in accordance with the invention.

The compositions of the solutions used are given below:

| | |
|---|---|
| [Pre-hardener] | |
| 6-Nitrobenzimidazole nitrate | 0.03 g |
| Anhydrous sodium sulfite | 0.8 g |
| Tetrahydro-2,3-dimethoxyfuran | 5 ml |
| Anhydrous sodium sulfate | 136 g |
| 35% Aqueous formalin soln. | 30 ml |
| Potassium bromide | 3.0 g |
| Water | to make up 1 liter. (adjusted to pH 4.9 with 18N sulfuric acid) |
| [Neutralizer] | |
| Hydroxylamine sulfate | 20 g |
| Sodium bromide | 18 g |
| Glacial acetic acid | 10 ml |
| Sodium acetate | 24 g |
| Anhydrous sodium sulfate | 45 g |
| Sodium hydroxide | 6.0 g |
| Water | to make up 1 liter. (adjusted to pH 5.0 with glacial acetic acid or sodium hydroxide) |
| [First developer] | |
| Quadrafos (R) (tetrasodium pyrophosphate) | 2 g |
| Phenidone | 0.25 g |
| Anhydrous sodium bisulfite | 50.0 g |
| Hydroquinone | 6.0 g |
| Sodium carbonate monohydrate | 30.0 g |
| Potassium bromide | 2.0 g |
| Sodium thiocyanate | 1.3 g |
| Sodium hydroxide | 6.0 ml |
| 0.1% aqueous potassium iodide soln. | 6.0 ml |
| Water | to make up 1 liter. |
| [First or second stop] | |
| Sodium acetate | 10.0 g |
| Glacial acetic acid | 36 ml |
| Water | to make up 1 liter. |
| [Color developer] | |
| Quadrafos(R) | 5.0 g |
| Sodium phosphate | 40.0 g |
| Sodium hydroxide | 5.0 g |
| Ethylene diamine | 2.0 g |
| Benzyl alcohol | 5.8 ml |
| t-butylaminoboran | 0.1 g |
| Citrazinic acid | 1.3 g |
| Kodak CD-3(R) | 11.3 g |
| Sodium bisulfite | 5.0 g |
| Water | to make up 1 liter. |
| [Stabilization] | |
| 35% aqueous formalin soln. | 7.0 ml |
| 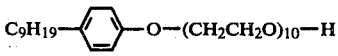 | 1.0 g |
| Water | to make up 1 liter. |
| [Bleach-fixing solution (a) for control] | |
| Diammonium EDTA | 10 g |
| Ferric EDTA complex salt | 67.5 g |
| Sodium sulfite | 10 g |
| 60% aqueous ammonium thiosulfate soln. | 150 ml |
| Ammonium thiocyanate | 15 g |
| Glacial acetic acid | 5 ml |
| Water | to make up 1 liter. (adjusted to pH 6.12 with 28% aqueous ammonium hydroxide solution; processed at 38° C.) |
| [Bleach-fixing solution (b)] | |
| 35% aqueous hydrogen peroxide soln. | 50 ml |
| Glacial acetic acid | 30 ml |

-continued

| | |
|---|---|
| Water | to make up 1 liter. (adjusted to pH 4.1 with sodium hydroxide; processed at 40° C.) |
| [Bleach-fixing solution (c)] | |
| 35% aqueous hydrogen peroxide soln. | 50 ml |
| 1-hydroxyethylidene 1,1-diphosphonic acid | 150 ml |
| Water | to make up 1 liter. (adjusted to pH 4.5 with sodium hydroxide; processed at 40° C.) |
| [Stain-removing bath] | |
| Ferric ammonium EDTA complex salt | 20 g |
| Ammonium iodide | 200 g |
| Polyvinyl pyrrolidone K 15 | 5 g |
| Water | to make up 1 liter. (adjusted to pH 6.5 with ammonium hydroxide) |

For comparison of bleach-fixing capacity of processes (A) and (B), the clearing time (time required for completion of bleach-fixing), the amount of remaining silver after process, and the minimum density of photographic characteristics are given in the following Table 1.

TABLE 1

| Properties / Process | Clearing time | Remaining silver amount | Minimum density red | green | blue |
|---|---|---|---|---|---|
| Control Process (by standard process) | | | 0.07 | 0.10 | 0.08 |
| (A) Bleach-fixing (a) | >20 min. | 12 mg/dm$^2$ | 0.31 | 0.41 | 0.62 |
| solution (b) | 50 sec. | 0 | 0.12 | 0.14 | 0.10 |
| (c) | 80 sec. | 0 | 0.13 | 0.14 | 0.11 |
| (B) Bleach-fixing (a) | >20 min. | 9 mg/dm$^2$ | 0.30 | 0.41 | 0.62 |
| solution (b) | 50 sec. | 0 | 0.06 | 0.08 | 0.08 |
| (c) | 80 sec. | 0 | 0.06 | 0.08 | 0.09 |

As is evident from Table 1, the process with the conventional bleach-fixing solution (a) brings about no clearing time even after 20 minutes of processing, the high remaining silver amount and the high minimum density and thus makes it difficult to process the high-sensitive color reversal material. In contrast thereto, the process with the bleach-fixing solution (b) or (c) of this invention containing hydrogen peroxide shortens the clearing time and decreases the remaining silver amount and thus completes the bleach-fixing within a short time, as compared with the process with the conventional bleach-fixing solution.

Further, the process with the bleach-fixing solution of the invention enables to keep substantially the same minimum density as in the control, and realizes a superior bleach-fixing properties.

The results of process (A) with bleach-fixing solutions show that the process with the bleach-fixing solution of the invention brings about a little higher minimum density than that in the control but decreases the remaining silver amount to zero and thus causes substantially no problem of photographic characteristics. The results of process (B) with bleach-fixing solutions show that, by using a stain-removing bath, the process with the bleach-fixing solution (b) or (c) of this invention keeps nearly the same minimum density as in the control and removes stains easily. Whereas, the process with the conventional bleach-fixing solution (a) brings about almost no difference in the minimum density depending on the presence or absence of the stain-removing bath.

It was confirmed that, besides the stain-removing bath comprising ferric EDTA complex salt and ammonium iodide employed in the Example, a bath comprising ferric EDTA complex salt and ammonium thiosulfate, or the like might also be employed.

It was also confirmed that not only the image dye obtained by the process with the bleach-fixing solution of the invention was quite comparable to that obtained by the control process with respect to color density, rectilinearity-maintaining property on the characteristics curve and other photographic characteristics, but also the image obtained itself could be preserved quite stable.

Thus, the bleach-fixing solutions (b) and (c) of the invention possess very superior bleach-fixing capacity.

Meanwhile, results similar to those shown in Table 1 were obtained where the bleach-fixing was performed immediately after, or through only washing, color development in the above-mentioned process B.

Further, better results were obtained than those shown in Table 1 in case the bleach-fixing was performed at 60° C. with the bleach-fixing solution of the invention.

EXAMPLE 2

Sakura Color-IIN-100 (a high-sensitive color negative film, available from Konishiroku Photo Ind. Co., Ltd.) was exposed quantitatively to a tungsten lamp, adjusting the color temperature to 4900° K. with a filter, and then processed in accordance with the following A and B:

(A) Process using bleach-fixing solutions (a)-(c)

The process was performed according to the following procedures:

[Color development, 3 min. 15 sec.]→[Acidic fixing, 3 min.]→[Water washing, 3 min.]→[Bleach-fixing, 10 min.]→[Water washing, 2 min.]→[Stabilization, 1 min.]→[Drying]:

(B) Process using bleach-fixing solutions (a)-(c) [Color development, 3 min. 15 sec.]→[Bleach-fixing, 10 min.]→[Acidic fixing, 3 min.]→[Water washing, 2 min.]→[Stabilization, 1 min.]→[Drying].

The entire procedures were performed at 38° C. except that bleach-fixing was performed at 45° C.

The compositions of the solutions for processing are given below:

| | |
|---|---|
| [Color developer] | |
| Sodium metaborate | 25.0 g |
| Sodium sulfite | 2.0 g |
| Hydroxylamine sulfate | 2.0 g |
| Potassium bromide | 0.5 g |
| Sodium hydroxide | 3.4 g |
| N-ethyl-N-β-methoxyethyl-3-methyl-4-aminoaniline tosylate | 6 g |
| Water | to make up 1 liter. (adjusted to pH 10.1 with sodium hydroxide) |
| [Stabilization] | |
| 35% aqueous formalin soln. | 7.0 ml |
| $C_9H_{19}$— 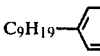 —O—$(CH_2CH_2O)_{10}$—H | 1 g |
| Water | to make up 1 liter. |

The compositions of bleach-fixing solutions (a), (b) and (c) are given below, wherein (a) is the bleach-fixing solution for control which is not in accordance with the invention, whereas the bleach-fixing solutions (b) and (c) are in accordance with the invention.

| | |
|---|---|
| [Bleach-fixing solution (a) for control] | |
| Ammonium EDTA | 10 g |
| Ferric EDTA complex salt | 67.5 g |
| Sodium sulfite | 10 g |
| 60% aqueous ammonium thiosulfate solution | 150 ml |
| Ammonium thiocyanate | 15 g |
| Glacial acetic acid | 5 ml |
| Water | to make up 1 liter (adjusted to pH 6.2 with 28% aqueous ammonium hydroxide solution) |
| [Bleach-fixing solution (b)] | |
| 35% aqueous hydrogen peroxide soln. | 60 ml |
| Glacial acetic acid | 50 ml |
| Water | to make up 1 liter. (adjusted to pH 4.5 with sodium hydroxide) |
| [Bleach-fixing solution (c)] | |
| 35% aqueous hydrogen peroxide soln. | 100 ml |
| Glacial acetic acid | 10 ml |
| Boric acid | 10 g |
| 1-Hydroxylethylidene diphosphonic acid | 50 ml |
| Water | to make up 1 liter (adjusted to pH 4.8 with sodium hydroxide) |
| [Acidic fixing solution] | |
| Sodium thiosulfate | 240 g |
| Sodium sulfite | 5 g |
| Glacial acetic acid | 5 ml |
| Potassium alum | 6 g |
| Water | to make up 1 liter |

For comparison of bleach-fixing capacity of processes (A) and (B), the remaining silver amount after process and the maximum density of photographic characteristics are given in the following Table 2.

TABLE 2

| Properties Process | | | Remaining Silver amount | Maximum density Red | Green | Blue |
|---|---|---|---|---|---|---|
| | Control Process (standard process) | | | 1.91 | 2.24 | 3.20 |
| (A) | Bleach-fixing solution | (a) | 4 mg/dm$^2$ | 2.28 | 2.51 | 3.54 |
| | | (b) | 0 | 2.01 | 2.22 | 3.24 |
| | | (c) | 0 | 1.90 | 2.28 | 3.01 |
| (B) | Bleach-fixing solution | (a) | 5.8 mg/dm$^2$ | 2.64 | 2.76 | 3.81 |
| | | (b) | 0 | 2.08 | 2.11 | 3.30 |
| | | (c) | 0 | 1.99 | 2.31 | 3.29 |

As shown in Table 2, the process with the conventional bleach-fixing solution brings about the high silver amount remaining and the high maximum density, and hence, does not complete bleach-fixing. In contrast thereto, the process with the bleach-fixing solution (b) or (c) of the invention brings about the remaining silver amount and the maximum density comparable to those of control process, and therefore, completes bleach-fixing.

It was confirmed that not only the image dye obtained by the process with the bleach-fixing solution of the invention was quite comparable to that obtained by the control process with respect to color density, rectilinearity-maintaining property on the characteristics curve and other photographic characteristics, but also the image obtained itself could be preserved quite stable.

Thus, the bleach-fixing solutions (b) and (c) of the invention possess very superior bleach-fixing capacity.

Meanwhile, results similar to those shown in Table 2 were obtained in cases where the bleach-fixing was performed at 24° C. or 65° C. in the above-mentioned process (A).

EXAMPLE 3

A sample of color reversal light-sensitive silver halide photographic material was prepared by coating on an undercoated polyethylenetelephthalate film the following silver halide emulsions in the following order: (1) a cyan forming red-sensitive silver halide emulsion prepared by adding and emulsifying cyan coupler, 1-hydroxy-2-n-α-(2,4-di-t-amylphenoxybutyl)naphthoamide to a red-sensitive silver iodobromide gelatin emulsion containing 9 moles % of silver iodide and coated on it so as to contain 2.0 g/m$^2$ of the coated silver amount; (2) a magenta forming green-sensitive silver halide emulsion prepared by adding and emulsifying magenta coupler, 1-(2,4,6-trichlorophenyl)-3-[2-chloro-3-(2,4-di-t-amylphenoxyacetamido)anilino]-5-pyrazolone to a green-sensitive silver iodobromide emulsion containing 8 moles % of silver iodide and coated on it so as to contain 2.0 g/m$^2$ of the coated silver amount; (3) a yellow forming blue-sensitive silver halide emulsion prepared by adding and emulsifying yellow coupler, α-benzoyl-[2-chloro-5-α-(dodecyloxycarbonyl)propyloxycarbonyl]acetanilide to a blue-sensitive silver iodobromide emulsion containing 7 moles % of silver halide and coated on it so as to contain 2.0 g/m$^2$ of the coated silver amount.

The prepared sample was wedge-exposed in the conventional manner to a determined exposure and treated by the following processes at 38° C.

Treatment processes

[First development (3 min. and 30 sec.)]→[First stopping (30 sec.)]→[First water washing (1 min.)]→[Color development (3 min. and 40 sec.)]→[Second stopping (1 min.)]→[Second water washing (1 min.)]→[Bleach-fixing (10 min.)]→[Stain removing bath (30 sec.)]→[Third water washing (1 min.)]→[Stabilizing (1 min.)]

The composition of each of the treatment solutions are shown as follows:

[First developer]

| | |
|---|---|
| Quadrafos (R) | 2 g |
| Phenidone | 0.25 g |
| Sodium sulphite(anhydrous) | 50.0 g |
| Hydroquinone | 6.0 g |
| Sodium carbonate (one hydrate) | 30.0 g |
| Potassium bromide | 2.0 g |
| Sodium thiocyanate | 1.3 g |
| Sodium hydroxide | 6.0 ml |
| Potassium iodide (0.1% aqueous solution) | 6.0 ml |
| Water to | 1 l |

[First and second stopping]

| | |
|---|---|
| Sodium acetate | 10 g |
| Glacial acetic acid | 30 ml |
| Water to | 1 l |

[Color developer]

| | |
|---|---|
| Quadrafos (R) | 5.0 g |
| Sodium phosphate | 40.0 g |
| Sodium hydroxide | 3.0 g |
| Ethylenediamine | 2.0 g |
| Benzyl alcohol | 5.8 ml |
| t-Butylaminoborane | 0.1 g |
| Citrazinic acid | 1.3 g |
| Kodak CD-3 (R) | 11.3 g |
| Sodium sulphite | 5.0 g |
| Water to | 1 l |

[Stain removing bath]

| | |
|---|---|
| Ethylenediaminetetraacetic acid iron (III)-ammonium complex salt | 30 g |
| Sodium sulphite | 7 g |
| Ammonium thiosulfate | 60 g |
| Water to | 1 l |

pH of the solution was regulated to 7.5 with ammonium solution

[Stabilizing bath]

| | |
|---|---|
| Formalin (35% aqueous solution) | 7.0 ml |
| $C_9H_{19}$—(C6H4)—O—$(CH_2CH_2O)_{10}$—H | 1 g |
| Water to | 1 l |

[Bleach-fixing solution (a)]

| | |
|---|---|
| Hydrogen peroxide solution (35%) | 50 ml |
| Glacial acetic acid | 25 ml |
| 1-Hydroxyethylidene-1,1-diphosphonic acid (60% aqueous solution) | 9.0 ml |
| Water to | 1 l |

The solution was adjusted to pH 4.5 with a sodium hydroxide solution.

[Bleach-fixing solution (b)]

| | |
|---|---|
| Hydrogen peroxide solution (35%) | 50 ml |
| Formic acid | 40 ml |
| 1-Hydroxyethylidene-1,1-diphosphonic acid (60% aqueous solution) | 20 ml |
| Water to | 1 l |

The solution was adjusted to pH 4.2 with a sodium hydroxide solution.

[Bleach-fixing solution (c)]

| | |
|---|---|
| Sodium perborate | 90 g |
| Propionic acid | 40 ml |
| 1-Hydroxyethylidene-1,1-diphosphonic acid (60% aqueous solution) | 20 ml |
| Water to | 1 l |

The solution was adjusted to pH 4.2 with a sodium hydroxide solution.

[Bleach-fixing solution (d)]

| | |
|---|---|
| Hydrogen peroxide solution (35%) | 60 ml |
| Potassium acetate | 30 g |
| 1-Hydroxyethylidene-1,1-diphosphonic acid | 20 ml |
| Water to | 1 l |

-continued

The solution was adjusted to pH 4.5 with a sodium hydroxide solution.

[Bleach-fixing solution (e)]

| | |
|---|---|
| Hydrogen peroxide solution (35%) | 30 ml |
| Oxalic acid | 28 g |
| 1-Hydroxyethylidene-1,1-diphosphonic acid (60% aqueous solution) | 50 ml |
| Water to | 1 l |

The solution was adjusted to pH 4.5 with a sodium hydroxide solution.

[Bleach-fixing solution (f)]

| | |
|---|---|
| Hydrogen peroxide solution (35%) | 30 ml |
| Succinic acid | 50 g |
| 1-Hydroxyethylidene-1,1-diphosphonic acid (60% aqueous solution) | 50 ml |
| Water to | 1 l |

The solution was adjusted to pH 4.2 with a sodium hydroxide solution.

[Bleach-fixing solution (g)]

| | |
|---|---|
| Hydrogen peroxide solution (35%) | 90 ml |
| Lactic acid | 80 g |
| 1-Hydroxyethylidene-1,1-diphosphonic acid (60% aqueous solution) | 140 ml |
| Water to | 1 l |

The solution was adjusted to pH 4.2 with a sodium hydroxide solution.

[Bleach-fixing solution (h)]

| | |
|---|---|
| Hydrogen peroxide solution (35%) | 60 ml |
| Citric acid | 60 g |
| 1-Hydroxyethylidene-1,1-diphosphonic acid (60% aqueous solution) | 50 ml |
| Water to | 1 l |

The solution was adjusted to pH 4.3 with a sodium hydroxide solution.

[Bleach-fixing solution (i)]

| | |
|---|---|
| Hydrogen peroxide solution (35%) | 100 ml |
| Tartaric acid | 120 g |
| 1-Hydroxyethylidene-1,1-diphosphonic acid (60% aqueous solution) | 40 ml |
| Water to | 1 l |

The solution was adjusted to pH 4.4 with a sodium hydroxide solution.

[Bleach-fixing solution (j)]

| | |
|---|---|
| Hydrogen peroxide solution (35%) | 80 ml |
| Aminoacetic acid | 30 g |
| 1-Hydroxyethylidene-1,1-diphosphonic acid (60% aqueous solution) | 30 ml |
| Water to | 1 l |

The solution was adjusted to pH 4.5 with a sodium hydroxide solution.

[Bleach-fixing solution (k)]

| | |
|---|---|
| Hydrogen peroxide solution (35%) | 50 ml |
| Glacial acetic acid | 10 g |
| Lactic acid | 60 g |
| 1-Hydroxyethylidene-1,1-diphosphonic acid (60% aqueous solution) | 5 ml |
| Water to | 1 l |

The solution was adjusted to pH 4.5 with a sodium hydroxide solution.

For comparison of the bleach-fixing efficiency of bleach-fixing solutions (a) to (k), the time for completion of desilverization, that is, the clearance time, the existence of blisters and the transparency of the highlight part caused by blistering, remaining silver amount and maximum density were measured and tabulated in Table 3.

TABLE 3

| Bleach-fixing solution | Clearing time min. | Clearing time sec. | Blistering | Transparency in highlight part | Remaining silver amount | Maximum density Red | Maximum density Green | Maximum density Blue |
|---|---|---|---|---|---|---|---|---|
| (a) | | 50 | not occur | transparent | 0 mg/100cm² | 1.92 | 2.24 | 2.96 |
| (b) | | 45 | " | " | " | 1.94 | 2.32 | 2.95 |
| (c) | | 55 | " | " | " | 1.92 | 2.26 | 4.98 |
| (d) | | 50 | " | " | " | 1.92 | 2.24 | 2.98 |
| (e) | 1 | 40 | " | " | " | 1.99 | 2.38 | 3.02 |
| (f) | 1 | 30 | " | " | " | 1.92 | 2.25 | 2.95 |
| (g) | 1 | 25 | " | " | " | 1.89 | 2.24 | 2.97 |

TABLE 3-continued

| Bleach-fixing solution | Clearing time min. | Clearing time sec. | Blistering | Transparency in highlight part | Remaining silver amount | Maximum density Red | Maximum density Green | Maximum density Blue |
|---|---|---|---|---|---|---|---|---|
| (h) | 1 | 30 | " | " | " | 2.01 | 2.26 | 3.95 |
| (i) | 1 | 20 | " | " | " | 1.96 | 2.08 | 3.01 |
| (j) | 1 | 40 | " | " | " | 1.92 | 2.24 | 2.91 |
| (k) | 1 | 05 | " | " | " | 1.97 | 2.30 | 2.98 |

Table 3 shows the following facts: the bleach-fixing solutions (a) to (k) consisting of hydrogen peroxide, alkylidene diphosphonic acid and a carboxylic acid according to this invention have a shorter clearing time and cause no blisters. Further, they have no trouble with transparency in the highlight part because there is no occurrence of blistering but have an excellent bleach-fixing efficiency.

They have also almost zero of the remaining silver amount and the maximum density is as high as that of the control (Please refer to Table 2).

In these treatment processes, a stain-removing bath was used but there could be found no substantial difference in stain density in the highlight part irrespective of use of it. But in cases where a sample to be tested has a colloidal silver antihalation layer, it was found that the use of the stain-removing bath is effective. Further, in cases where pH of the bleach-fixing solutions was adjusted to form 2.5 to 3.5, the same results were obtained as in Table 3.

It was found that the image dyes obtained by treatment with bleach-fixing solutions (a) to (k) according to this invention have excellent photographic characteristics of color density and the straightness of the characteristic curve as compared with the conventional process treatments and the images obtained have excellent preservability and stability.

As shown above, the bleach-fixing solutions (a) to (k) according to this invention have excellent bleach-fixing capacity.

In the above treatment, in cases where the bleach-fixing process is directly carried out after color development or the bleach-fixing process through only the water washing process, the same results could be obtained as in Table 3.

Further, in cases where the bleach-fixing process was carried out at 60° C., the prohibiting effect on blistering and the clearance time due to use of the bleach-fixing solution according to this invention were better than the results shown in Table 3.

EXAMPLE 4

A sample of color reversal light-sensitive silver halide photographic material was prepared by coating on a polyethylene laminate support the following silver halide in the following order: (1) a cyan forming red-sensitive silver halide emulsion prepared by adding and emulsifying cyan coupler, 5-[α-(2,4-di-t-acylphenoxy)-hexamido]-2-(α,α,β,β-tetrafluoropropioamido)phenol to a red-sensitive silver iodobromide emulsion containing 4.0 mol % of silver iodide and coated so as to contain 1.9 g/m$^2$ of the coated silver amount; (2) a magenta forming green-sensitive silver halide emulsion prepared by adding and emulsifying magenta coupler, 1-(2,4,6-trichlorophenyl)-3-[3-(2,4-di-t-amylphenoxyacetamido)anilino]-5-pyrazolone to a green-sensitive silver iodobromide emulsions so as to contain 1.7 g/m$^2$ of the coated silver amount; and (3) a yellow forming green-sensitive emulsion prepared by adding and emulsifying yellow coupler, α-pivalyl-α-(3-benzyl-2,5-dioxohydantoyl-3)-2-chloro-5-{γ(2,4-di-t-amylphenoxy)-butylamido}acetanilide to a blue-sensitive silver iodobromide containing 4.0 mol % of silver iodide so as to contain 2.1 g/m$^2$ of the coated silver.

The sample thus prepared was wedge-exposed in the conventional way to a certain light exposure and processed at 29.4° C.

Treatment processes

[First development (3 min.)]→[Stopping (1 min. and 35 sec.)]→[First water washing (3 min. and 15 sec.)]→[Second exposure (1 min.)]→[Color development (3 min. and 15 sec.)]→[Second water washing (1 min. and 35 sec.)]→[Bleach-fixing (6 min.)]→[Third water washing (3 min. and 15 sec.)]→[Stabilizing (1 min. and 35 sec.)]→[Spray rinse (35 sec.)]

The compositions of each of the treatment solutions, except the bleach-fixing solution, were Kodak.Ektaprint.R14, (Chemicals.Liquid), First developer, Color developer and Stabilizer which were dissolved respectively in a determined manner. The bleach-fixing solutions of (a) to (k) as in Example 3 were used.

For comparison of the bleach-fixing abilities of bleach-fixing solutions (a) to (k), the clearing time and blister occurrence were measured after desilverizing and shown in Table 4.

TABLE 4

| Bleach-fixing solution | Clearing time min. | Clearing time sec. | Blistering |
|---|---|---|---|
| (a) | | 55 | No occurrence |
| (b) | | 45 | " |
| (c) | | 55 | " |
| (d) | | 55 | " |
| (e) | 1 | 50 | " |
| (f) | 1 | 20 | " |
| (g) | 1 | 20 | " |
| (h) | 1 | 40 | " |
| (i) | 1 | 35 | " |
| (j) | 1 | 45 | " |
| (k) | | 55 | " |

This table shows that the clearing times are short and blisters do not occur.

After the bleach-fixing treatment, the stain-removing bath in Example 3 was used but no substantial difference could be found. Besides these treatments, after color development, stopping, water washing and bleach-fixing treatments were carried out and the same results as in Table 6 were obtained. Besides the above treatments, the pH of bleach-fixing solutions was adjusted to 2.5 and 3.5 respectively but the same results as in Table 4 were obtained.

EXAMPLE 5

The same color reversal light-sensitive silver halide photographic material was prepared as in Example 3. This sample was exposed to a definite light exposure through a light-wedge in a conventional way and treated at 38° C. as follows:

The treatment processes were the same as in Example 3 using the following compositions of the solutions.

| | |
|---|---|
| [First developer] | |
| Quadrafos$^{(R)}$ | 2 g |
| Phenidone | 0.25 g |
| Sodium sulphite (anhydrous) | 50.0 g |
| Hydroquinone | 6.0 g |
| Sodium carbonate (monohydrate) | 30.0 g |
| Potassium bromide | 2.0 g |
| Sodium thiocyanate | 1.3 g |
| Sodium hydroxide | 6.0 ml |
| Potassium hydroxide (0.1% aqueous solution) | 6.0 ml |
| Water to | 1 l |
| [First, Second stopping] | |
| Sodium acetate | 10 g |
| Glacial acetic acid | 30 ml |
| Water to | 1 l |
| [Color developer] | |
| Quadrafos$^{(R)}$ | 5.0 g |
| Trisodium phosphate | 40.0 g |
| Sodium hydroxide | 3.0 g |
| Ethylenediamine | 2.0 g |
| Benzyl alcohol | 5.8 ml |
| Butylaminoborane | 0.1 g |
| Citrazinic acid | 1.3 g |
| Kodack CD-3$^{(R)}$ | 11.3 g |
| Sodium sulphite | 5.0 g |
| Water to | 1 l |
| [Stain-removing bath] | |
| Ethylenediaminetetraaceto iron (III) ammonium complex | 30 g |
| Sodium sulfite | 7 g |
| Ammonium thiosulfate | 60 g |
| Water to | 1 l |
| The solution was adjusted to pH 7.5 with ammonia solution. | |
| [Stabilizing bath] | |
| Formalin (35% aqueous solution) | 7.0 ml |
| $C_9H_{19}$—⟨benzene⟩—O—$(CH_2CH_2O)_{10}$—H) | 1 g |
| Water to | 1 l |
| [Bleach-fixing solution (1)] | |
| Hydrogen peroxide (35%) | 50 ml |
| Sodium chloride | 0.3 g |
| Glacial acetic acid | 30.0 ml |
| Water to | 1 l |
| The solution was adjusted to pH 4.5 with a sodium hydroxide solution. | |
| [Bleach-fixing solution (2)] | |
| Hydrogen peroxide (35%) | 50 ml |
| Sodium hydroxide | 0.3 g |
| Glacial acetic acid | 32 ml |
| 1-Hydroxyethylidene-1,1-diphosphonic acid (60% aqueous solution) | 10 ml |
| Water to | 1 l |
| The solution was adjusted to pH 4.5 with a sodium hydroxide solution. | |
| [Bleach-fixing solution (3)] | |
| Hydrogen peroxide (35% aqueous solution) | 60 ml |
| Sodium chloride | 0.3 g |
| Glacial acetic acid | 30 ml |
| Barium nitrate | 2 g |
| Water to | 1 l |
| The solution was adjusted to pH 4.5 with a sodium hydroxide solution. | |
| [Bleach-fixing solution (4)] | |
| Hydrogen peroxide (35% aqueous solution) | 50 ml |
| Sodium chloride | 0.3 g |
| Glacial acetic acid | 30 ml |
| Osmic acid | 0.05 g |
| Water to | 1 l |
| The solution was adjusted to pH 4.3 with a sodium hydroxide solution. | |
| [Bleach-fixing solution (5)] | |
| Hydrogen peroxide (35% aqueous solution) | 50 ml |
| Sodium chloride | 0.3 g |
| Glacial acetic acid | 20.0 ml |
| 1-Hydroxyethylidene-1,1-diphosphonic acid (60% aqueous solution) | 10.0 ml |
| Osmic acid | 0.01 g |
| Water to | 1 l |
| The solution was adjusted to pH 4.3 with a sodium hydroxide solution. | |
| [Bleach-fixing solution (6)] | |
| Hydrogen peroxide (35% aqueous solution) | 50 ml |
| Glacial acetic acid | 25 ml |
| Sodium chloride | 0.3 g |
| 1-Hydroxyethylidene-1,1-diphosphonic acid (60% aqueous solution) | 9.0 ml |
| Tungsten (III) oxide | 0.5 g |
| Water to | 1 l |
| The solution was adjusted to pH 4.5 with a sodium hydroxide solution. | |
| [Bleach-fixing solution (7)] | |
| Hydrogen peroxide (35% aqueous solution) | 50 ml |
| Glacial acetic acid | 40 ml |
| Sodium chloride | 0.3 g |
| 1-Hydroxyethylidene-1,1-diphosphonic acid (60% aqueous solution) | 20 ml |
| Calcium nitrate | 1.0 g |
| Water to | 1 l |
| The solution was adjusted to pH 4.2 with a sodium hydroxide solution. | |
| [Bleach-fixing solution (8)] | |
| Sodium perborate | 90 g |
| Glacial acetic acid | 40 ml |
| Sodium hydroxide | 0.3 g |
| 1-Hydroxyethylidene-1,1-diphosphonic acid (60% aqueous solution) | 5 ml |
| Platinum trioxide | 0.5 g |
| Water to | 1 l |
| The solution was adjusted to pH 4.2 with a sodium hydroxide solution. | |
| [Bleach-fixing solution (9)] | |
| Hydrogen peroxide (35% aqueous solution) | 60 ml |
| Potassium acetate | 36 g |
| Sodium chloride | 0.2 g |
| 1-Hydroxyethylidene-1,1-diphosphonic acid (60% aqueous solution) | 20 ml |
| Gold hydroxide | 0.1 g |
| Water to | 1 l |
| The solution was adjusted to pH 4.5 with a sodium hydroxide solution. | |
| [Bleach-fixing solution (10)] | |
| Hydrogen peroxide (35% aqueous solution) | 50 ml |
| Propionic acid | 42 g |
| Sodium chloride | 0.3 g |
| 1-Hydroxyethylidene-1,1-diphosphonic acid (60% aqueous solution) | 5.0 ml |
| Osmic acid | 0.01 g |
| Water to | 1 l |
| The solution was adjusted to pH 4.5 with a sodium hydroxide solution. | |
| [Bleach-fixing solution (11)] | |
| Hydrogen peroxide (35% aqueous solution) | 30 ml |
| Succinic acid | 50 g |
| Sodium chloride | 0.2 g |
| 1-Hydroxyethylidene-1,1-diphosphonic acid (60% aqueous solution) | 40 ml |
| Barium nitrate | 2.0 g |
| Water to | 1 l |
| The solution was adjusted to pH 4.2 with a sodium hydroxide solution. | |
| [Bleach-fixing solution (12)] | |
| Hydrogen peroxide (35% aqueous solution) | 90 ml |
| Sodium chloride | 0.3 g |
| Lactic acid | 80 g |
| 1-Hydroxyethylidene-1,1-diphosphonic acid (60% aqueous solution) | 100 ml |
| Thalium nitrate | 2.0 g |
| Water to | 1 l |
| The solution was adjusted to pH 4.2 with a sodium hydroxide solution. | |
| [Bleach-fixing solution (13)] | |
| Hydrogen peroxide (35% aqueous solution) | 60 ml |
| Sodium chloride | 0.3 g |
| Citric acid | 60 g |
| Silver sulfate | 1.5 g |
| 1-Hydroxyethylidene-1,1-diphosphonic acid (60% aqueous solution) | 50 ml |

-continued

The solution was adjusted to pH 4.3 with a sodium hydroxide solution.

[Bleach-fixing solution (14)]

| | |
|---|---|
| Hydrogen peroxide (35% aqueous solution) | 100 ml |
| Sodium chloride | 0.3 g |
| Tartaric acid | 120 g |
| 1-Hydroxyethylidene-1,1-diphosphonic acid (60% aqueous solution) | 40 ml |
| Zinc nitrate | 3.5 g |
| Water to | 1 l |

The solution was adjusted to pH 4.4 with a sodium hydroxide solution.

[Bleach-fixing solution (15)]

| | |
|---|---|
| Hydrogen peroxide (35% aqueous solution) | 60 ml |
| Sodium chloride | 0.3 g |
| 1-Hydroxyethylidene-1,1-diphosphonic acid (60% aqueous solution) | 20 ml |
| Glacial acetic acid | 25 ml |
| Calcium sulfate | 2.0 g |
| Water to | 1 l |

The solution was adjusted to pH 4.5 with a sodium hydroxide solution.

[Bleach-fixing solution (16)]

| | |
|---|---|
| Hydrogen peroxide (35% aqueous solution) | 50 ml |
| Sodium hydroxide | 0.3 g |
| Glacial acetic acid | 30 g |
| Strontium nitrate | 4 g |
| Water to | 1 l |

The solution was adjusted to pH 4.3 with a sodium hydroxide solution.

[Bleach-fixing solution (17)]

| | |
|---|---|
| Hydrogen peroxide (35% aqueous solution) | 50 ml |
| Sodium chloride | 0.3 g |
| Propionic acid | 40 g |
| Zinc nitrate | 2.4 g |
| Water to | 1 l |

The solution was adjusted to pH 4.3 with a sodium hydroxide solution.

[Bleach-fixing solution (18)]

| | |
|---|---|
| Hydrogen peroxide (35% aqueous solution) | 60 ml |
| Sodium chloride | 0.3 g |
| Glacial acetic acid | 30 ml |
| Zinc sulfate | 3.0 g |
| Water to | 1 l |

The solution was adjusted to pH 4.0 with a sodium hydroxide solution.

[Bleach-fixing solution (19)]

| | |
|---|---|
| Hydrogen peroxide (35% aqueous solution) | 50 ml |
| Glacial acetic acid | 25 ml |
| 1-Hydroxyethylidene-1,1-diphosphonic acid (60% aqueous solution) | 9.0 ml |
| Gallium sulfate | 2.8 g |
| Water to | 1 l |

The solution was adjusted to pH 4.5 with a sodium hydroxide solution.

[Bleach-fixing solution (20)]

| | |
|---|---|
| Hydrogen peroxide (35% aqueous solution) | 50 ml |
| Glacial acetic acid | 30 ml |
| 1-Hydroxyethylidene-1,1-diphosphonic acid (60% aqueous solution) | 5 ml |
| Indium hydroxide | 6 g |
| Water to | 1 l |

The solution was adjusted to pH 4.2 with a sodium hydroxide solution.

[Bleach-fixing solution (21)]

| | |
|---|---|
| Sodium perborate | 90 g |
| Sodium chloride | 0.2 g |
| Glacial acetic acid | 30 ml |
| 1-Hydroxyethylidene-1,1-diphosphonic acid (60% aqueous solution) | 5 ml |
| Titanium sulfate | 3 g |
| Water to | 1 l |

The solution was adjusted to pH 4.5 with a sodium hydroxide solution.

[Bleach-fixing solution (22)]

| | |
|---|---|
| Hydrogen peroxide (35% aqueous solution) | 60 ml |
| Sodium hydroxide | 0.2 g |
| 1-Hydroxyethylidene-1,1-diphosphonic acid (60% aqueous solution) | 5.0 ml |
| Glacial acetic acid | 30 ml |
| Zirconium sulfate | 8 g |

The solution was adjusted to pH 4.5 with a sodium hydroxide solution.

[Bleach-fixing solution (23)]

| | |
|---|---|
| Hydrogen peroxide (35% aqueous solution) | 50 ml |
| Sodium chloride | 0.3 g |
| Glacial acetic acid | 30 ml |
| Stannous oxide | 5 g |
| Water to | 1 l |

The solution was adjusted to pH 4.3 with a sodium hydroxide solution.

[Bleach-fixing solution (24)]

| | |
|---|---|
| Hydrogen peroxide (35% aqueous solution) | 50 ml |
| Sodium chloride | 0.2 g |
| Propionic acid | 40 g |
| Bismuth nitrate | 10 g |
| Water to | 1 l |

The solution was adjusted to pH 4.3 with a sodium hydroxide solution.

[Bleach-fixing solution (25)]

| | |
|---|---|
| Hydrogen peroxide (35% aqueous solution) | 60 ml |
| Sodium chloride | 0.2 g |
| Glacial acetic acid | 30 ml |
| Bismuth oxide | 26 g |
| Water to | 1 l |

The solution was adjusted to pH 4.0 with a sodium hydroxide solution.

[Bleach-fixing solution (26)]

| | |
|---|---|
| Hydrogen peroxide (35% aqueous solution) | 50 ml |
| Sodium chloride | 0.2 g |
| Glacial acetic acid | 25 ml |
| 1-Hydroxyethylidene-1,1-diphosphonic acid (60% aqueous solution) | 9.0 ml |
| Vanadium (V) oxide | 1.0 g |
| Water to | 1 l |

The solution was adjusted to pH 4.5 with a sodium hydroxide solution.

[Bleach-fixing solution (27)]

| | |
|---|---|
| Hydrogen peroxide (35% aqueous solution) | 50 ml |
| Sodium chloride | 0.2 g |
| Glacial acetic acid | 40 ml |
| 1-Hydroxyethylidene-1,1-diphosphonic acid (60% aqueous solution) | 5.0 ml |
| Water to | 1 l |

The solution was adjusted to pH 4.2 with a sodium hydroxide solution.

[Bleach-fixing solution (28)]

| | |
|---|---|
| Sodium perborate | 90 g |
| Sodium chloride | 0.2 g |
| Propionic acid | 40 ml |
| 1-Hydroxyethylidene-1,1-diphosphonic acid (60% aqueous solution) | 5 ml |
| Molybdenum (VI) oxide | 2.6 g |
| Water to | 1 l |

The solution was adjusted to pH 4.5 with a sodium hydroxide solution.

[Bleach-fixing solution (29)]

| | |
|---|---|
| Hydrogen peroxide (35% aqueous solution) | 60 ml |
| Sodium chloride | 0.2 g |
| 1-Hydroxyethylidene-1,1-diphosphonic acid (60% aqueous solution) | 5.0 ml |
| Glacial acetic acid | 25 ml |
| Iridium (IV) oxide | 8 g |
| Water to | 1 l |

The solution was adjusted to pH 4.5 with a sodium hydroxide solution.

[Bleach-fixing solution (30)]

| | |
|---|---|
| Hydrogen peroxide (35% aqueous solution) | 50 ml |
| Sodium chloride | 0.2 g |
| Glacial acetic acid | 30 ml |
| Palladium sulfate | 3 g |
| Water to | 1 l |

The solution was adjusted to pH 4.3 with a sodium hydroxide solution.

[Bleach-fixing solution (31)]

| | |
|---|---|
| Hydrogen peroxide (35% aqueous solution) | 50 ml |
| Sodium chloride | 0.2 g |
| Propionic acid | 40 g |
| Rhodium (III) oxide | 4 g |
| Water to | 1 l |

The solution was adjusted to pH 4.3 with a sodium hydroxide solution.

[Bleach-fixing solution (32)]

| | |
|---|---|
| Hydrogen peroxide (35% aqueous solution) | 60 ml |

-continued

| | |
|---|---|
| Sodium chloride | 0.2 g |
| Glacial acetic acid | 30 ml |
| Ruthenium (IV) oxide | 6 g |
| Water to | 1 l |
| The solution was adjusted to pH 4.5 with a sodium hydroxide solution. | |

For comparing bleach-fixing abilities of bleach-fixing solutions (1) to (32), after desilverization, clearing times, remaining silver amounts and minimum densities (D min) in red, green and blue were measured and shown in Table 7.

TABLE 5

| Bleach-fixing solution | Clearing time | | Remaining silver amount | Minimum Density | | |
|---|---|---|---|---|---|---|
| | min. | sec. | (mg/100 cm$^2$) | Red | Green | Blue |
| 1 | 8 | 50 | 0 | 0.15 | 0.14 | 0.09 |
| 2 | 8 | 25 | 0 | 0.14 | 0.14 | 0.09 |
| 3 | 2 | 10 | 0 | 0.14 | 0.14 | 0.07 |
| 4 | | 52 | 0 | 0.10 | 0.11 | 0.07 |
| 5 | | 38 | 0 | 0.10 | 0.12 | 0.07 |
| 6 | 2 | 20 | 0 | 0.11 | 0.14 | 0.08 |
| 7 | 2 | 05 | 0 | 0.12 | 0.14 | 0.09 |
| 8 | 1 | 40 | 0 | 0.10 | 0.14 | 0.07 |
| 9 | 1 | 50 | 0 | 0.10 | 0.14 | 0.07 |
| 10 | | 55 | 0 | 0.11 | 0.14 | 0.08 |
| 11 | 2 | 30 | 0 | 0.12 | 0.14 | 0.09 |
| 12 | 3 | 10 | 0 | 0.12 | 0.13 | 0.08 |
| 13 | 1 | 30 | 0 | 0.11 | 0.12 | 0.08 |
| 14 | 2 | 50 | 0 | 0.14 | 0.15 | 0.09 |
| 15 | 3 | 20 | 0 | 0.14 | 0.15 | 0.09 |
| 16 | 3 | 15 | 0 | 0.15 | 0.15 | 0.10 |
| 17 | 3 | 00 | 0 | 0.13 | 0.12 | 0.09 |
| 18 | 2 | 50 | 0 | 0.12 | 0.14 | 0.09 |
| 19 | 3 | 10 | 0 | 0.14 | 0.14 | 0.09 |
| 20 | 3 | 30 | 0 | 0.14 | 0.14 | 0.09 |
| 21 | 3 | 10 | 0 | 0.13 | 0.14 | 0.09 |
| 22 | 3 | 15 | 0 | 0.14 | 0.14 | 0.09 |
| 23 | 2 | 40 | 0 | 0.14 | 0.13 | 0.08 |
| 24 | 1 | 50 | 0 | 0.11 | 0.13 | 0.08 |
| 25 | 1 | 45 | 0 | 0.11 | 0.12 | 0.08 |
| 26 | 1 | 10 | 0 | 0.12 | 0.12 | 0.09 |
| 27 | 1 | 35 | 0 | 0.11 | 0.14 | 0.08 |
| 28 | 3 | 20 | 0 | 0.15 | 0.14 | 0.08 |
| 29 | 3 | 40 | 0 | 0.15 | 0.14 | 0.09 |
| 30 | 2 | 50 | 0 | 0.13 | 0.14 | 0.09 |
| 31 | 3 | 20 | 0 | 0.15 | 0.14 | 0.09 |
| 32 | 3 | 15 | 0 | 0.14 | 0.14 | 0.09 |

As is clear from Table 5, with the treatment of bleach-fixing solutions (1) and (2), short clearing times could not obtained. Thus, the bleach-fixing solution containing hydrogen peroxide and halide ions causes a silver ion to dissolve out, resulting in reducing the treatment ability so that it was found to be difficult to treat high-sensitive color reversal photosensitive materials with them.

On the contrary, with the treatment of bleach-fixing solutions (3) to (32) containing an inorganic salt, the clearing times are short and residual silver amounts are almost zero even if halogen ions are contained. These facts show that bleach-fixing can be finished in a short time. Minimum densities are very low and troubles with stain or bad desilverization in highlight part can not be found. From the above going, it is concluded that the bleach-fixing solution containing an inorganic salt, even when inhibiting materials such as a halogen ion are mixed in it, can display excellent bleach-fixing abilities.

A stain-removing bath was used in these treatment but there could be found no substantial difference in stain density, whether it was used or not.

As to the stain-removing bath, a bath containing ethylenediaminetetraaceto iron (III) ammonium complex and thiosulfate salt was used. A bath containing ethylenediamine tetraaceto iron (III) complex and ammonium iodide or ammonium bromide or ethylenediaminetetraaceto iron (III) complex and a thiocyanate can also be used to give the same results as in Table 5.

Further, a bath containing only ammonium iodide can easily remove stains.

The image dyes obtained with the bleach-fixing solution according to this invention has excellent photographic characteristics of color density and straightness in characteristic curve as well as storage stability.

After color development in the above treatments, in cases where the bleach-fixing is directly carried out or via water washing treatment, the same results were obtained as in Table 5. When the bleach-fixing was carried out at 30° C. and 60° C., the substantially same results were obtained as in Table 5.

Further, with bleach-fixing solutions (1) to (9) high-sensitive color negative film were treated to give the same results as in Table 5. It was recognized that any treatment process has an excellent bleach-fixing ability for any color photographic materials. Besides the above treatments, pH of the bleach-fixing solution was adjusted to 2.5 to 3.5 with sulfuric acid to give the same results as in Table 5.

EXAMPLE 6

Bleach-fixing solutions (1') and (4') were prepared in the same compositions of bleach-fixing solutions (1) and (4) as in Example 5 except that 0.3 g/l of sodium chloride was removed respectively from the solutions (1) and (4). With said bleach-fixing solutions (1') and (4') the same samples as in Example 5 were continuously treated in the same conditions as in Example 5 until the bleaching ability ran out. The treating ability obtained of the solution (1') was 1.4 m$^2$ and that of the solution (4') was 4.7 m$^2$. These results show that the bleach-fixing solution of this invention is extremely excellent on treating a large amount of films.

What is claimed is:

1. A method for processing a light-sensitive silver halide color photographic material which has been exposed to an image which comprises removing, after color development of said exposed light-sensitive silver halide color photographic material, the image silver with a bleach-fixing bath having a pH of between 2.0 and 5.5 and containing (i) hydrogen peroxide or sodium perborate in an amount of 0.05 mole to 3.0 moles/l and (ii) at least one organic acid or salt thereof selected from the group consisting of lower aliphatic carboxylic acids having the general formula I or II and alkali metal salts, other than metal complex salts, of said carboxylic acids.

formula I $$R_1—COOH$$

wherein $R_1$ is a hydrogen atom or an alkyl group having 1 to 3 carbon atoms which may may be substituted with one or more of hydroxyl, alkyl having 1 to 3 carbon atoms and amino radicals;

formula II $$HOOC—(R_2)_{n1}—COOH$$

wherein $R_2$ is an alkylene or alkenylene group having 1 to 5 carbon atoms, each of which may be substituted with one or more of hydroxyl, alkyl having 1 to 3 carbon atoms, carboxyl and amino radicals, and $n_1$ is zero or 1; and alkylidene diphosphonic acids having the general formula III and alkali metal salts thereof formula III

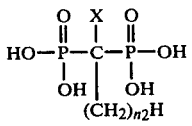

wherein X is a hydrogen atom or hydroxyl, and $n_2$ is zero or an integer from 1 to 5.

the amounts of said aliphatic carboxylic acids of the formula I or II and said alkylidene diphosphonic acids of the formula III being 0.05 mole to 3.0 moles/l and 0.01 to 1.0 mole/l, respectively.

2. A method as claimed in claim 1 in which said bath also contains at least one inorganic salt of a metal selected from the group consisting of silver, gold, calcium, strontium, barium, zinc, gallium, indium, thallium, tin, lead, titanium, zirconium, bismuth, vanadium, chromium, molybdenum, tungsten, ruthenium, rhodium, palladium, osmium, iridium, platinum and cerium.

3. A method as claimed in claim 2 in which said inorganic salt is selected from the group consisting of a barium salt, osmium salt, tungstate salt, silver salt, gold salt, platinum salt, celium salt, chromium salt and a selenium salt.

4. A method as claimed in claim 2 in which said bath contains said inorganic salt in an amount of $10^{-5}$ to 0.5 mole/l.

5. A method as claimed in claim 1 wherein said organic acid or salt thereof is selected from the group consisting of formic acid, acetic acid, propionic acid, citric acid and alkali metal salts thereof.

6. A method as claimed in claim 1 wherein said organic acid or salt thereof is selected from the group consisting of methylene diphosphonic acid, ethylidene diphosphonic acid, 1-hydroxyethylidene-1,1-diphosphonic acid, 1-hydroxypropylidene-1,1-diphosphonic acid, 1-hydroxybutylidene-1,1-diphosphonic acid and alkali metal salts thereof.

7. A method as claimed in claim 1 wherein said organic acid or salt thereof is the compound (I) or (II).

8. A method as claimed in claim 7, wherein said bath is at a temperature of from 35° to 60° C.

9. A method as claimed in claim 8, wherein said bath also contains at least one inorganic salt selected from the group consisting of a barium salt, osmium salt, tungstate salt, silver salt, gold salt, platinum salt, celium salt, chromium salt and a selenium salt.

10. A method as claimed in claim 9, wherein said organic salt is in an amount of between $10^{-4}$ and $10^{-1}$ mole/l.

11. A method as claimed in claim 1 wherein said organic acid or salt thereof is the compound (III) in an amount of 0.01 to 1.0 mole/l.

12. A method as claimed in claim 1, wherein said bath is at a temperature of from 35° to 60° C.

13. A method as claimed in claim 12, wherein said bath also contains at least one inorganic salt selected from the group consisting of a barium salt, osmium salt, tungstate salt, silver salt, gold salt, platinum salt, celium salt, chromium salt and a selenium salt.

14. A method as claimed in claim 13, wherein said organic salt is in an amount of between $10^{-4}$ and $10^{-1}$ mole/l.

15. A method as claimed in claim 14, wherein said bath contains one of said lower aliphatic carboxylic acids and also one of said alkylidene diphosphonic acids.

16. A method as claimed in claim 1 wherein said bath is at a temperature of 20° to 90° C.

17. A method as claimed in claim 1, wherein said bath contains one of said lower aliphatic carboxylic acids and also one of said alkylidene diphosphonic acids.

* * * * *